US006261212B1

(12) United States Patent
Vallone et al.

(10) Patent No.: US 6,261,212 B1
(45) Date of Patent: Jul. 17, 2001

(54) ADJUSTABLE RESISTANCE REHABILITATION EXERCISE DEVICE

(76) Inventors: Anthony John Vallone, 3812 Woodliegh Dr. NW., Canton, OH (US) 44718; John Frank Vallone, 63 Crestmont Rd., Binghamton, NY (US) 13905

( * ) Notice: Subject to any disclaimer, the term of this patent is extended or adjusted under 35 U.S.C. 154(b) by 0 days.

(21) Appl. No.: 09/389,881

(22) Filed: Sep. 3, 1999

(51) Int. Cl.[7] ..... A63B 21/018
(52) U.S. Cl. ..... 482/120; 482/904
(58) Field of Search ..... 482/114, 115, 482/118–120, 904; 182/5; 188/65.4, 65.5

(56) References Cited

U.S. PATENT DOCUMENTS

| | | | | |
|---|---|---|---|---|
| 3,460,392 | * | 8/1969 | Kolbel | 482/120 |
| 3,550,449 | * | 12/1970 | Henson | 482/120 |
| 4,293,127 | * | 10/1981 | Dudley | 482/120 |
| 4,294,446 | * | 10/1981 | Moore | 482/120 |
| 4,476,956 | * | 10/1984 | Eger | 182/5 |
| 4,728,102 | * | 3/1988 | Pauls | 482/118 |
| 5,038,888 | * | 8/1991 | Varner et al. | 182/5 |
| 5,486,149 | * | 1/1996 | Smith et al. | 482/120 |
| 5,709,636 | * | 1/1998 | Vallone et al. | 482/129 |

* cited by examiner

*Primary Examiner*—Mickey Yu
*Assistant Examiner*—Victor Hwang

(57) ABSTRACT

A adjustable resistance rehabilitation exercise device for use by individuals without supervision to follow prescribed or desired iterative cycles of therapeutic exercise regimens is provided. The adjustable resistance rehabilitation exercise device preferably includes a pilot pulley assembly and a adjustable resistance control spooler assembly, mounted and secured to individual 'O' clamp and/or channeled 'U' clamp assemblies, interconnected by a flexible cord, with bayonet clips secured at both ends of the cord, and supplemented with hand grips, precision straight scale, multi-purpose harness assembly and anchoring device. The 'O' clamp and channeled 'U' clamp screw assemblies may be disassembled and employed in either of two 'O' clamp screw holes and also are interchangeable between the 'O' and Channeled 'U' clamps. The pilot pulley assembly is configured with a single grooved roller and performs the primary function of establishing and maintaining a tangential path for the flexible cord travel from the adjustable resistance control spooler assembly to the pilot pulley roller to minimize friction and resultant added exercise forces. The adjustable resistance rehabilitation exercise device accessories include hand grip(s) and a precision, spring style, straight scale for calibrating and verifying prescribed and preset exercise forces for individual therapeutic regimens.

20 Claims, 8 Drawing Sheets

VIEW A

A-3

A-4

A-1

ADJUSTABLE RESISTANCE REHABILITATION EXERCISE DEVICE

FIELD OF THE INVENTION

The present invention is related to portable exercise devices and more particularly to orthopedic devices having retaining harnesses and handgrips threaded through pulley assemblies.

BACKGROUND OF THE INVENTION

U.S. Pat. No. 5,709,636 which is owned by the same assignees (Anthony J. and John F. Vallone Sr.) as this invention, discloses a portable exercise orthopedic device which allows prescribed rehabilitative physical therapy regimes to be safely applied and controlled by the patient (user) at home and/or by qualified physical therapists and technicians in a treatment facility.

Weakened muscles attributed to injuries, debilitating illnesses and surgical procedures require rehabilitative isometric as well as progressive and constant isotonic exercise regimens to help restore strength. In the past and currently, the prescribed exercise regimens have been applied using weights, elasticized bands, serial pulley configurations and a variety of other high and low tech devices and exercises to restore strength and an acceptable degree of flexibility and/or range of motion to affected muscles and orthopedic joints..

Currently, no device is known, which may be used conveniently and effectively at home or at a treatment facility by either the patient, the physical therapist or qualified technician for applying a range of predefined measured and controlled isometric and isotonic resistance to afflicted muscles.

PRIOR ART

U.S. Pat. No. 5,709,636 to Vallone et al., provides the portability and adaptability to standard home furnishings/environments, ease of use either in the home or treatment facility, measurement of stresses encountered during isometric and progressive isotonic muscle strengthening exercise regimes and is also applicable to regimes for stretching orthopedic joints.

The basic system disclosed in the '636 patent, however, provided distinct improvements in terms of portability, flexibility and adaptability to the physical therapy rehabilitation processes, as defined in Prior Art in '636 and below, over previous devices which lacked these prime characteristics.

The present invention was designed to satisfy the requirement for an adaptable portable exercise device to facilitate muscle strengthening. The present design allows for inclusion of an adjustable resistance control spooler assembly device to provide repetitive exercise regimens for overloading to strengthen muscles.

Such devices as defined within U.S. Pat. No. 4,896,881 to Djerdjerian employing cables, pulleys and weights, requires a complex door frame assembly to host the exercise device which has primary application to muscle building and toning regimens with little to no defined applications to measurable and controlled orthopedic rehabilitation therapies. Similarly, U.S. Pat. No. 5,468,205 to McFall et al., and U.S. Pat. No. 4,685,670 to Zinik primarily focus on muscle building and toning regimens employ elasticized cords to apply stresses required for effective exercise routines. A major drawback to elasticized bands is the variable stresses encountered through a singular cycle of exercise in that as the band is stretched the resistive stresses increase. As such, neither of these two devices have any apparent application to prescribed measurable and controlled resistive isometric and isotonic exercise regimens.

U.S. Pat. No. 5,303,716 to Mason et al., provides a viable platform for passive suspension and passive range of motion exercises for the hip and knee. However, as such, the device is restrictive to the hip and knee and does not provide the capabilities for predefined and preset measured and controlled application of stress forces on the afflicted leg and/or leg joints, and in the classical sense of portability is not readily adaptable to standard home furnishings/environments.

Other patented devices which were evaluated, and found deficient in terms of portability, adaptability to the physical therapy rehabilitation exercise routines, and in satisfying the predefined and preset measurable and controllable stresses criteria include:

U.S. Pat. No. 4,848,741 to Hermanson

U.S. Pat. No. 4,944,511 to Francis

U.S. Pat. No. 655,671 to Crooker and McDonald

OBJECTS AND SUMMARY OF THE INVENTION

The principal objective of this invention is to provide a complementary device, fully compatible with components of patent '636 to Vallone et al., to apply iterative cycles of predefined and preset measured and controlled constant stress levels for constant isotonic resistance exercise regimens that involve overloading the muscles to build strength. This invention, however, does not negate the applications of the Portable Exercise Device equipage and employment for exercise regimens programs, as defined within '636.

It is also the objective of this invention to provide an exercise device which is fully portable, is readily adaptable to standard home furnishings as well as treatment facility platforms, is easy to use by lay persons as well as trained therapy technicians, and which can be manufactured and constructed economically.

Accordingly, the present invention includes use of a adjustable resistance control spooler (here-in-after referred to as the ARC spooler) assembly, an harness assembly and clamping devices to provide high degree of adaptability in detachably affixing the device(s) to home and office furnishings as well as treatment facilities exercise platforms. These assemblies augmented by clamps, a pilot pulley, a flexible cord assembly and a plurality of hand grips comprise the embodiment of a portable exercise device which provides a wide spectrum of isometric as well as constant and progressive isotonic exercise regimens. In this respect, the design constraints of the ARC spooler assembly and the channeled 'U'—clamp are such as to ensure interchangeable mountings of the ARC spooler and/or the pilot pulley assemblies to either the channeled 'U' clamp or the 'O' clamp assemblies.

In '636, the portable exercise device allows multiple angle isometric strengthening for weakend muscles resulting from post operative surgery. The adjustable resistance rehabilitation exercise device, as defined within this patent, provides for iterative progressive or constant isotonic resistive physical therapy exercise cycles for prescribed rehabilitation therapeutic exercise regimens which involve overloading muscles to build strength.

In either configuration, employment of the precision straight scale allows accurate and consistent measurement and progression, or lack thereof, of muscle strength to verify progress towards established rehabilitation goals. Measurable baseline and verifiable progress of rehabilitative regimens are important not only to the physical therapist in establishing successive exercise goals, but have major ramifications in the insurance aspects of rehabilitative care.

DETAILED DESCRIPTION

Figure 5:
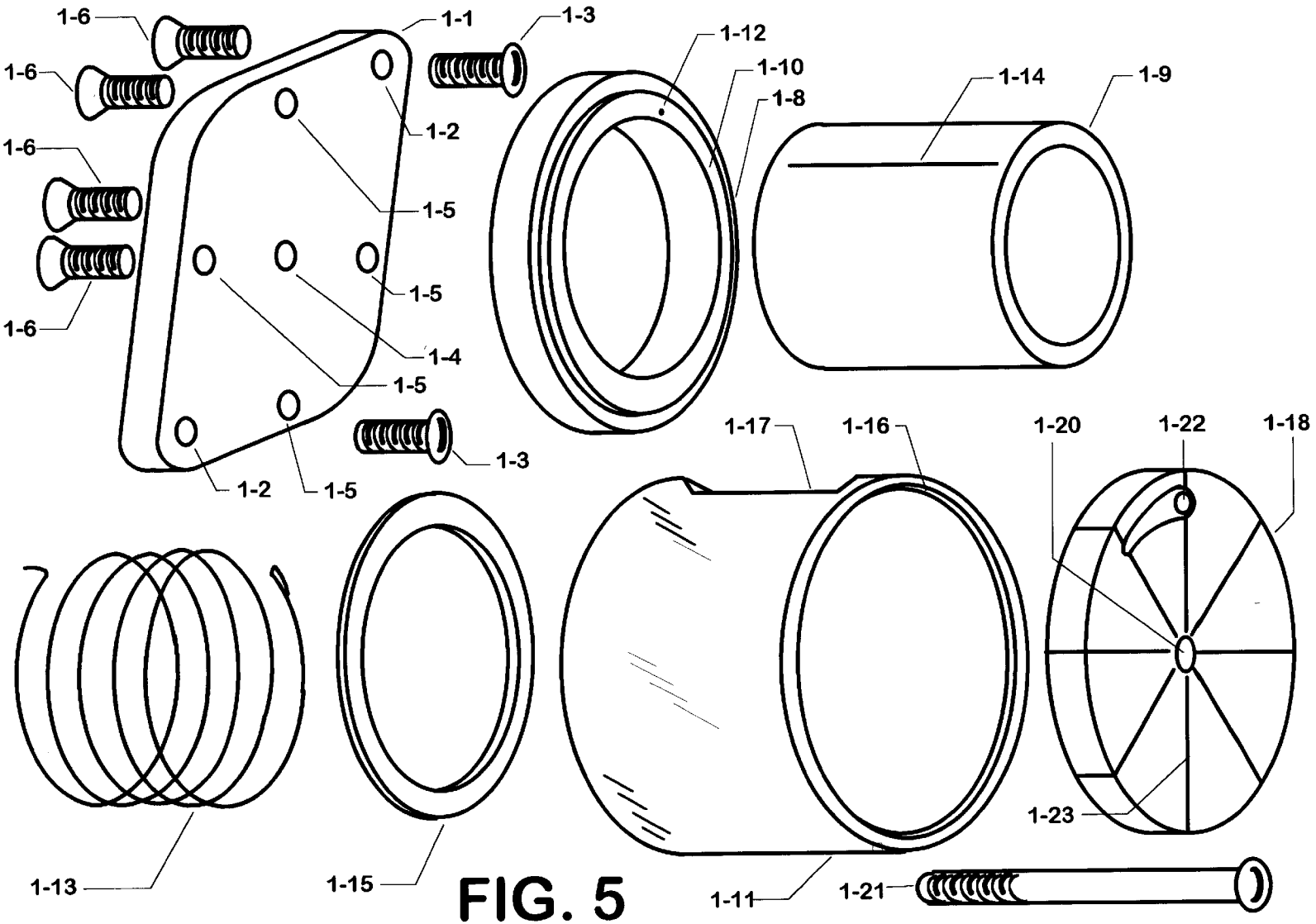
FIG. 5 is an exploded view of the ARC spooler assembly.
Figure 6B:
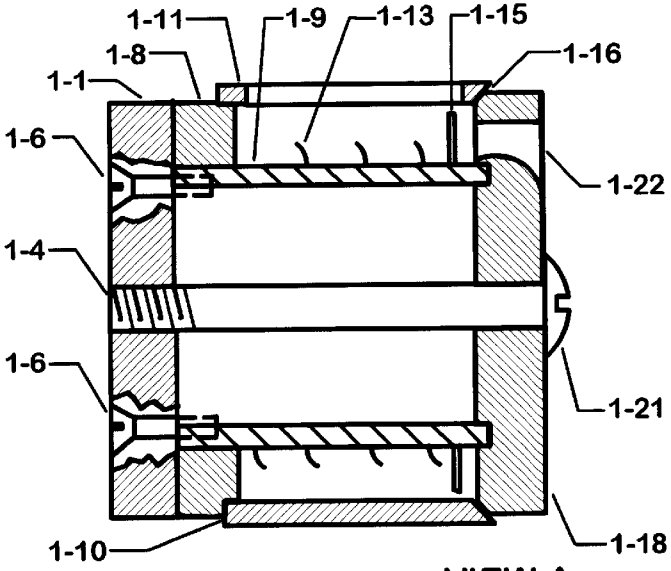
FIG. 6A–D provides an orthographic view, with pertinent cross-sectional representations, of the ARC spooler assembly.
Figure 6D:
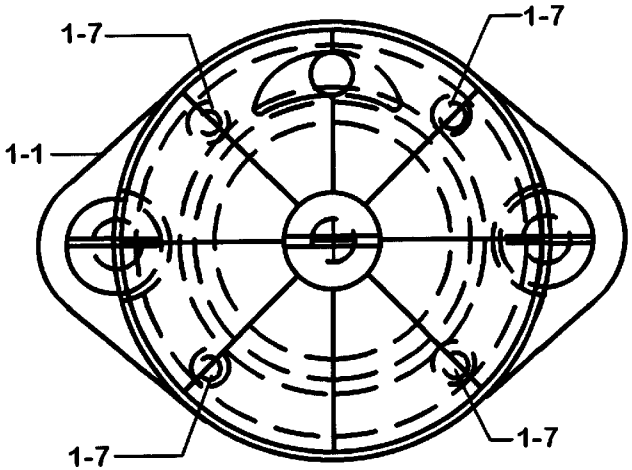
Figure 6A:
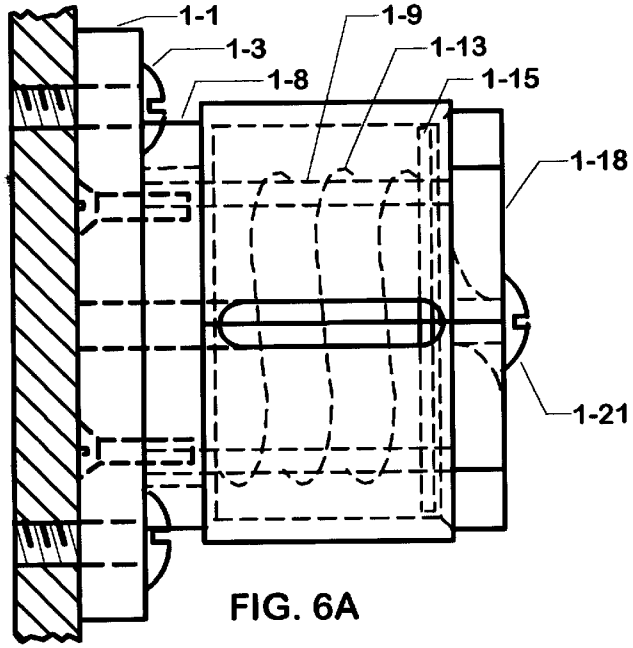
Figure 6C:
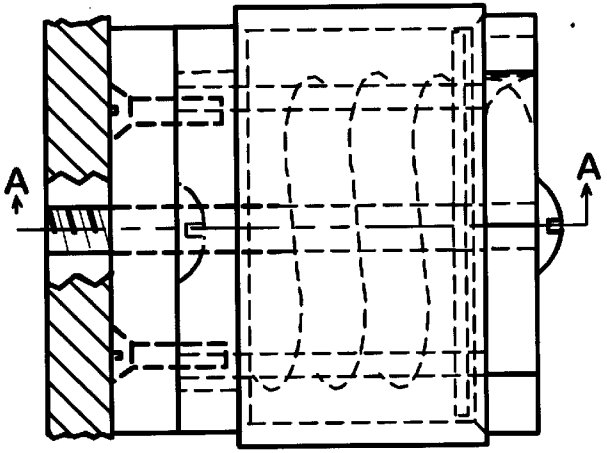

As depicted in drawings (FIGS. 1 through 16) the preferred embodiment of the adjustable resistance rehabilitation exercise device, in accordance with this invention includes the ARC spooler assembly 1. Referring to FIGS. 5 and 6, the ARC spooler assembly is comprised of baseplate 1-1 which is configured with two non-threaded holes 1-2 spaced apart to accommodate two carriage bolts 1-3 for detachably affixing the ARC spooler assembly to the channeled 'U' clamp 2 and 'O' Clamps 3. Threaded hole 1-4 is centered on the baseplate between ports 1-2. Four non-threaded holes 1-5 are spaced at 90° intervals, through which four machine screws 1-6 screwed into four threaded holes 1-7 secure the main assembly mounting ring 1-8 to the baseplate.

The main assembly mounting ring has an inside diameter to accommodate the spooler sleeve 1-9. The mounting ring has a collar (boss) 1-10 to accommodate the spooler's exterior casing and cord guide 1-11 and a drilled hole 1-12 to position and secure the spooler's compression spring 1-13.

The spooler sleeve has an index line 1-14 inscribed lengthwise along the top outer surface to provide the reference point for incrementally presetting the spooler's resistance windings around the spooler sleeve. The spooler sleeve is inserted through the mounting ring and backed-up flush against the ARC spooler base plate.

Compression spring 1-13 fits over the spooler sleeve and is anchored in mounting ring hole 1-12. The compression spring pressure plate 1-15 fits over the spooler sleeve against the end of, and interacts with, the compression spring to maintain a sufficient pressure to keep exercise cord A-3.1 windings properly aligned linearly along the ARC spooler sleeve.

The ARC spooler assembly exterior casing and cord guide 1-11, encloses the spooler sleeve, compression spring and pressure plate and is positioned over the mounting ring boss 1-10. The casing has a machined cord guide slot 1-17 and a chamfered inside circumference 1-16 to fit the chamfered outside circumference of the ARC indexed face plate 1-18.

The index face plate 1-18 is configured with a chamfered inner edge to mate with and apply locking pressure upon the exterior casing and cord guide 1-16. A circular dado 1-19 is machined into the inner facing of the index plate to host and secure the ARC spooler sleeve. A port 1-20 is provided to accommodate screw 1-21 to secure the main assembly to the ARC baseplate through the baseplate threaded hole 1-4. Port 1-22, for feeding the exercise cord into the ARC spooler assembly, is machined into the indexed face plate at an angle of 30° (degrees) from the horizontal plane to minimize binding of the exercise cord 4 as it feeds through the indexed face plate to the ARC spooler sleeve.

Index markers 1-23 are inscribed into the outer facing of the face plate at 45 degree intervals from port 1-22 centerline (top dead center) to align with ARC spooler sleeve index marker 1-14 to permit cord windings ranging from ⅛th turn on the ARC spooler sleeve up to four (4) complete windings around the sleeve at ⅛th winding per increment.

Figures 7A, 7B:
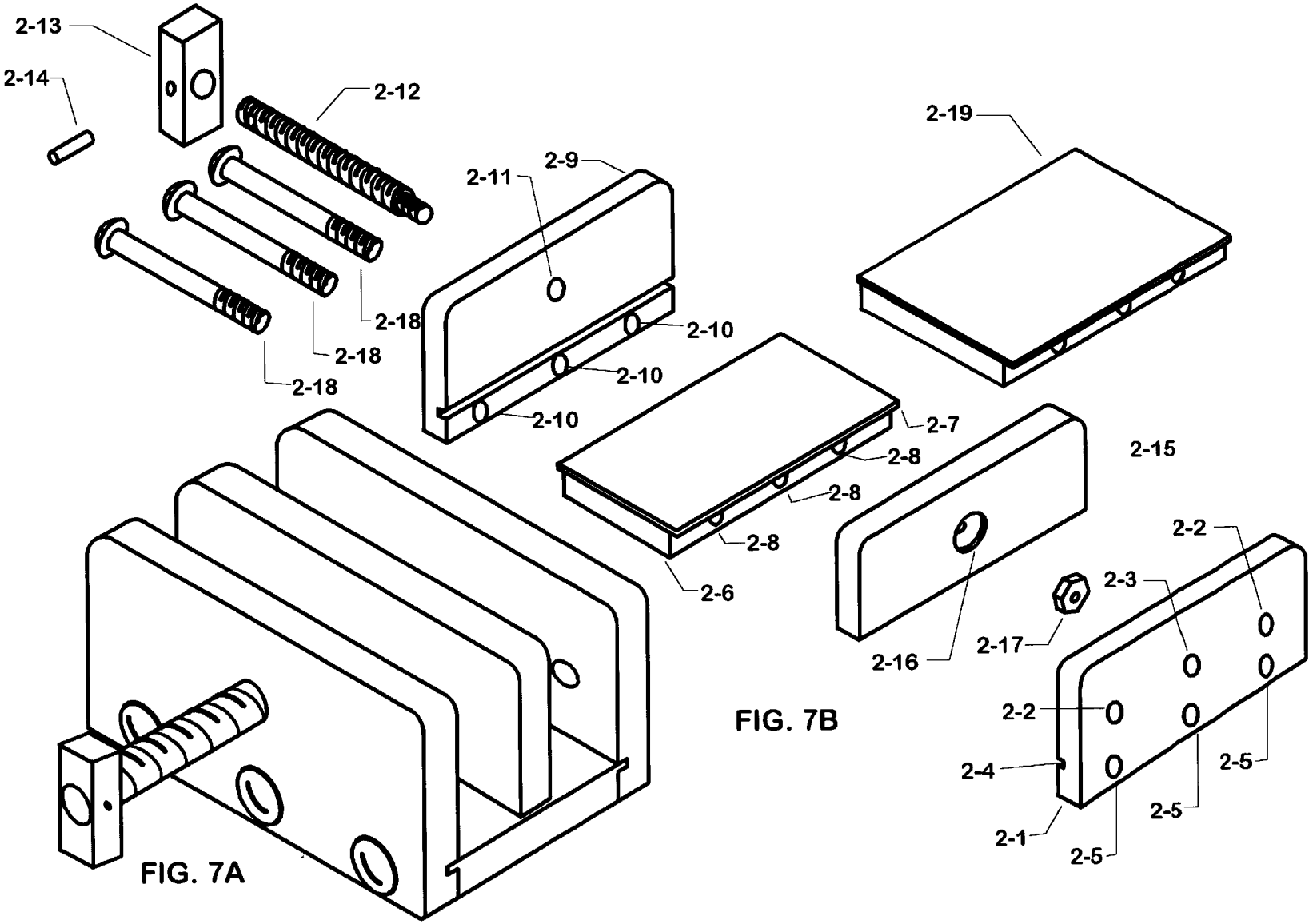
FIGS. 7A and 7B provides an isometric and exploded view of the Channeled 'U' Clamp assembly.

Referring now to FIG. 7, the channeled 'U' clamp 2 preferred embodiment includes backplate 2-1 having two threaded holes 2-2, spaced apart to accommodate two carriage bolts 1-3 to detachably affix the ARC spooler assembly and/or the pilot pulley assembly 4 to the clamp(s). Non-threaded port 2-3, centered between the two threaded holes 2-2 accommodates the pilot pulley's roller axle 4-4.

A dadoed groove 2-4 and three threaded holes 2-5 are alined horizontally along the lower portion of the backplate to accommodate the channeled 'U' clamp baseplate 2-6. The lengthwise top edges 2-7 of the baseplate are tenoned to fit the backplate dado and three non-threaded holes 2-8 are drilled through the baseplate to aline with backplate's three threaded holes 2-5.

The frontal plate 2-9, similar to the backplate, is dadoed and has three non-threaded holes 2-10 to align coincident with the holes through the baseplate and the threaded holes in the backplate. Threaded hole 2-11 is centered horizontally and vertically (in respect to the operational depth of the clamp) on the frontal plate to host clamp screw 2-12 which consists of a handle 2-13 (which is secured to the clamp screw by dowel 2-14). Pressure plate 2-15 non threaded hole 2-16 is counterbored to accept hex nut 2-17 to secure the pressure plate to the clamp screw assembly.

The channeled 'U' clamp is assembled by three machine screws 2-18 which pass through non threaded holes 2-10 in the frontal plate, non threaded holes 2-8 in the baseplate and screwed into threaded holes 2-5 in the backplate.

An optional plurality of alternate base plates 2-19 provide for expanding/decreasing the operational width of the channeled 'U' clamp. Each additional baseplate requires three machine screws 2-18 of appropriate length to accommodate assembly.

Figures 8, 9, 10:
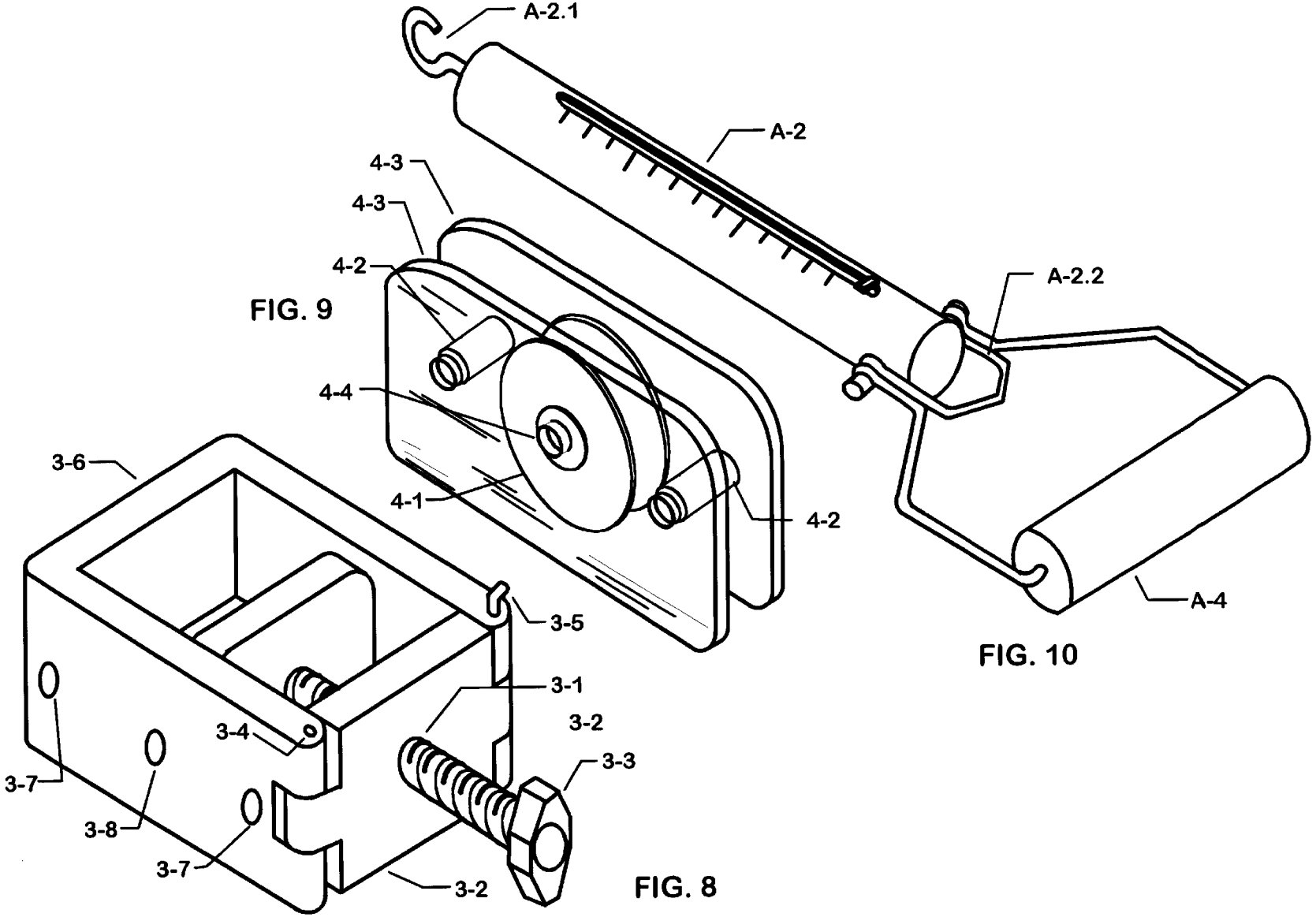
FIG. 8 depicts the 'O' Clamp.
FIG. 9 is the isometric view of the Pilot Pulley assembly.
FIG. 10 depicts the Precision Straight Scale, with integrated hand grip.

While the channeled 'U' clamp is designed for attachment to flat surfaces such as cross members, table leafs, side boards and doors, the 'O' clamp 3 is designed for attachment to furniture legs, poles and posts. Referring to FIG. 8, the 'O' clamp preferred embodiment includes a threaded hole 3-1 centered on a pinioned hatch 3-2 to accommodate clamp screw assembly 3-3, identical to and interchangeable with clamp screw assembly components for the channeled 'U' clamp. Pinioned hatch 3-2 is rotatably affixed to the 'O' clamp main frame 3-6 by fixed dowel 3-4. Removable dowel 3-5 allows the pinioned hatch to be rotated (opened) to permit detachably affixing the clamp to designated exercise platform legs, poles or shafts and then replaced to lock the pinion hatch in place. Two threaded holes 3-7 spaced apart to accommodate two carriage bolts 1-3 to detachably affix the adjustable resistance spooler assembly 1 and/or the pilot pulley assembly 4 to the clamp. Non-threaded hole 3-8, centered between tow threaded holes 3-7, accommodates the pilot pulley roller axle 4-4.

As depicted in FIG. 9, the pilot pulley assembly 4 construction is comprised of a single roller 4-1 and two spacers 4-2 sandwiched between two pulley side panels 4-3. The single roller is mated to the pulley by dowel 4-4. Dowel 4-4 inserted through the pulley side panels, the roller and into non-threaded hole 2-3 (channeled 'U' clamp) and/or non-threaded hole 3-3 ('O' clamp) functions as the roller axle and alines the roller with its respective mounting clamp.

Figure 1:
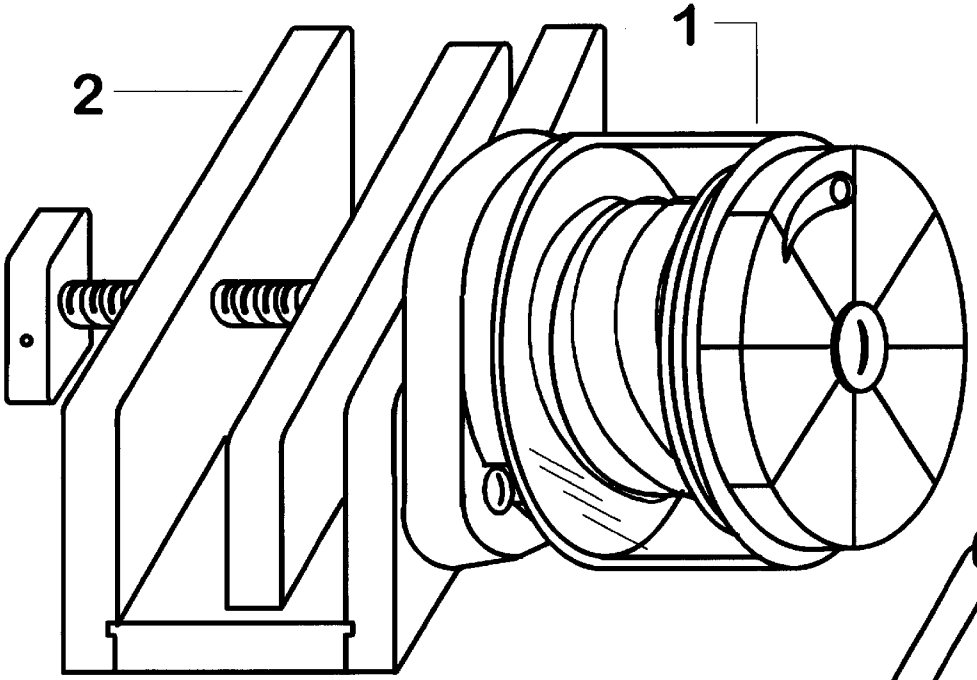
FIG. 1 is an oblique projection view of the ARC spooler assembly mounted to a channeled 'U' clamp assembly.
Figure 2:
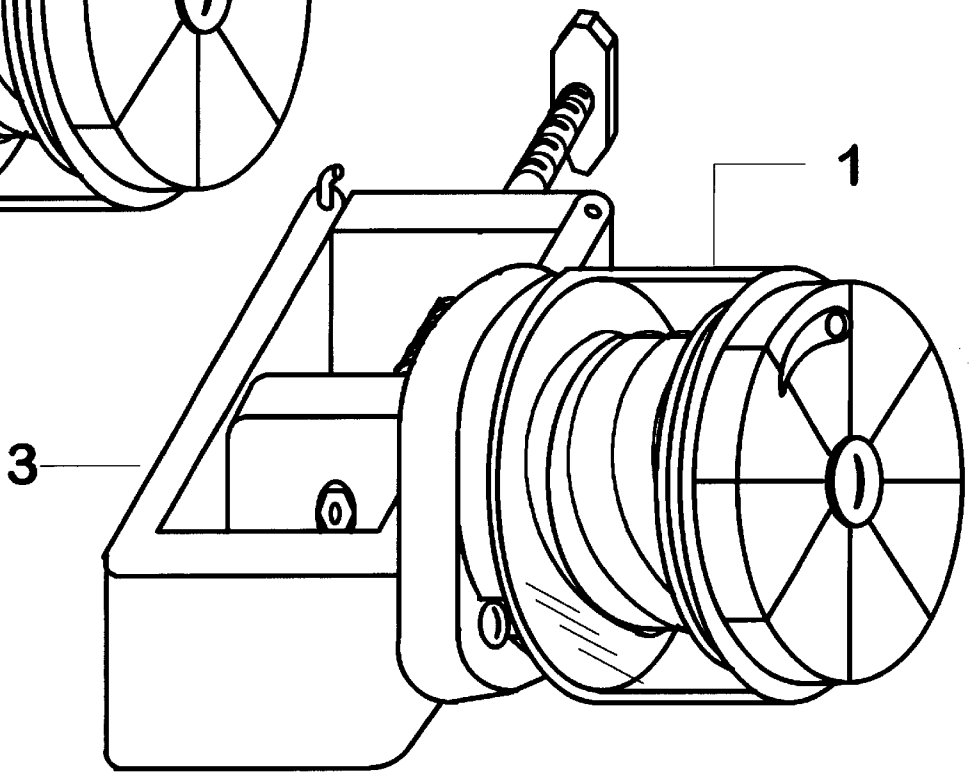
FIG. 2 is an oblique projection view of the ARC spooler assembly mounted to an 'O' clamp assembly.
Figures 3, 4:
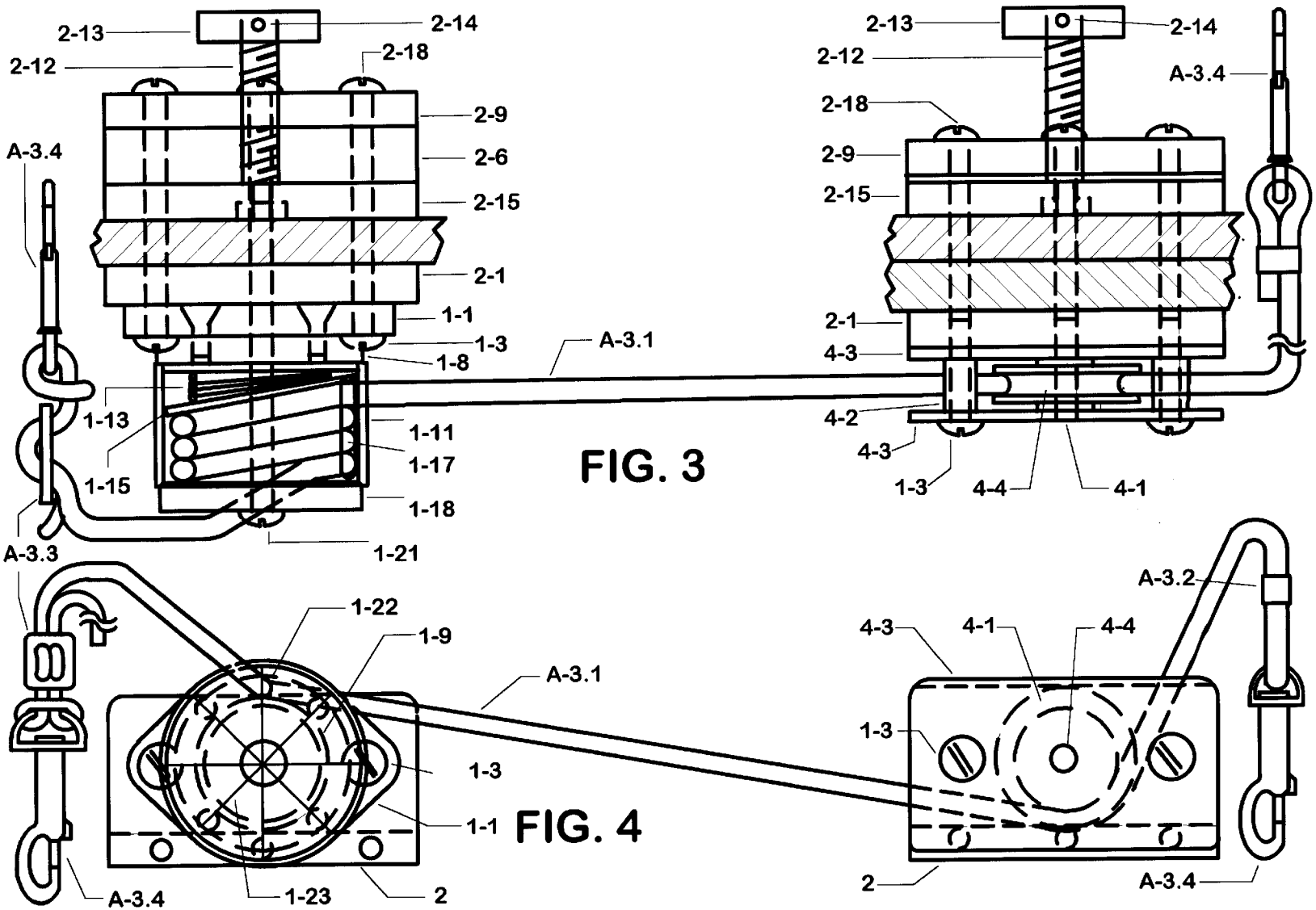
FIG. 3 is the top view of the adjustable resistance rehabilitation exercise device (mounted to channeled 'U' clamps).
FIG. 4 is the side view of FIG. 3.
Figures 11, 12, 13, 14:
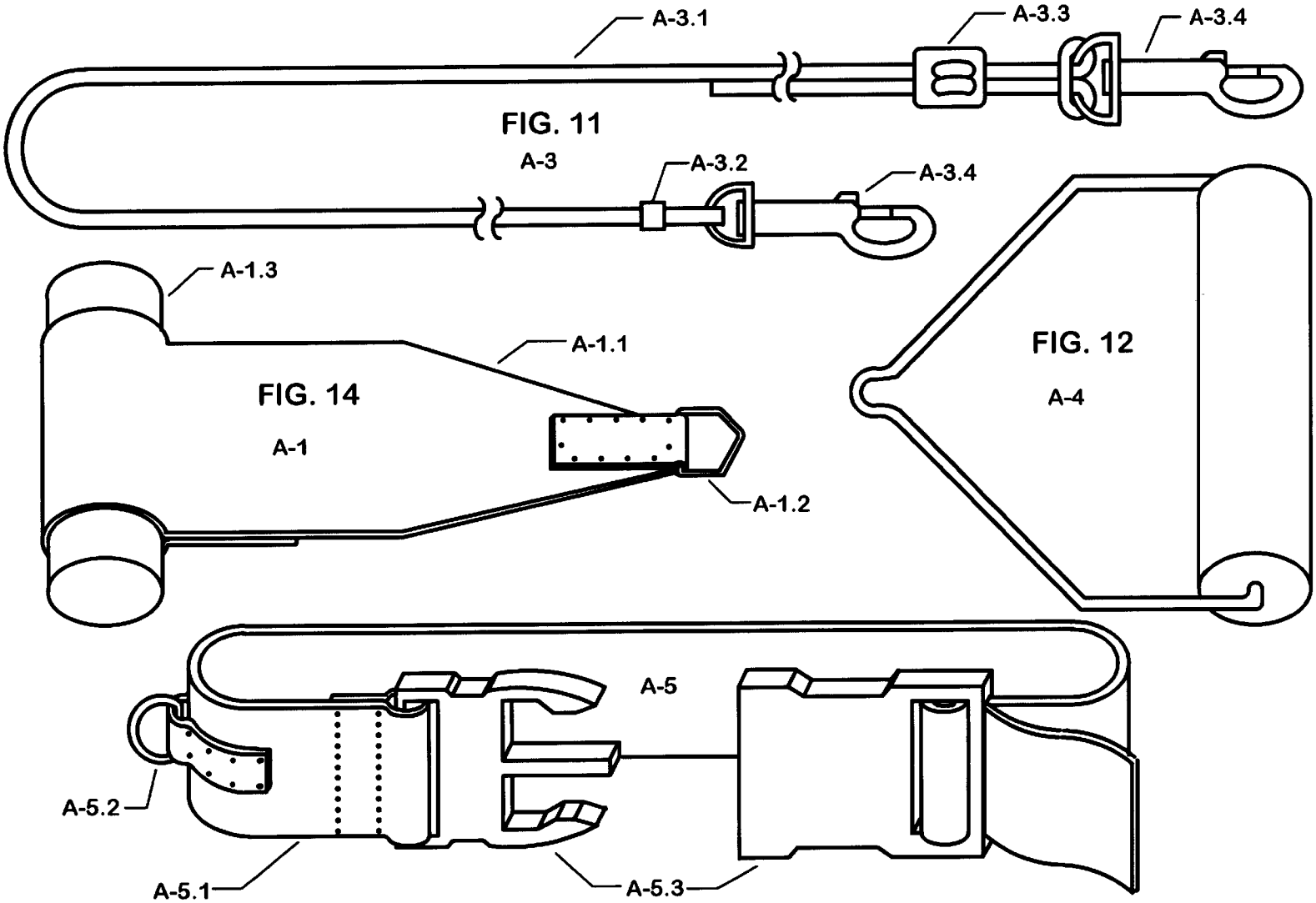
FIG. 11 depicts the Exercise cord with a fixed bayonet clip on one end and a detachably affixed and adjustable bayonet clip on the other.
FIG. 12 depicts a hand grip, used as an accessory item to the invention
FIG. 13 depicts a multi-purpose harness—adjustable for adaptation to limbs, head and torso
FIG. 14 depicts a door anchor used as an accessory item to this patent.
Figure 15:
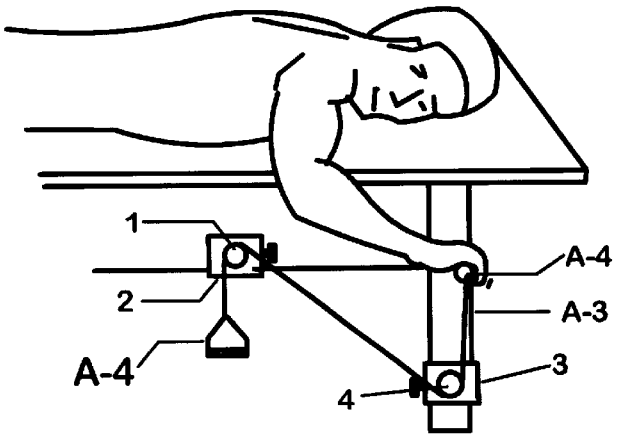
FIG. 15 provides a representation of the adjustable resistance rehabilitation exercise device for isolating intraspinatus and teres minor routines.
Figure 16:
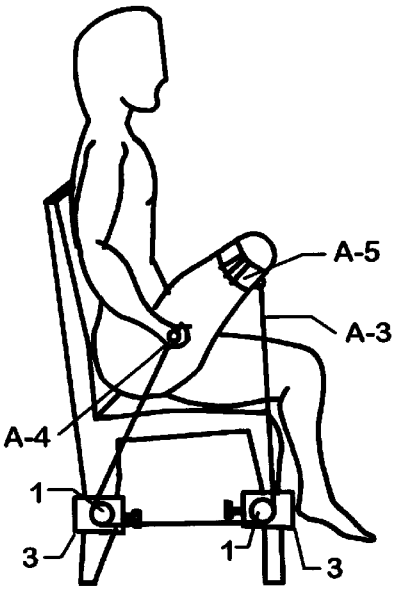
FIG. 16 provides a representation of the adjustable resistance rehabilitation exercise device for active/resistive hip flexor exercises.

The ARC spooler assembly mounted to either the channeled 'U' clamp 2 (as depicted in FIG. 1, 'O' clamp 3 (as depicted in FIG. 2) or otherwise directly detachably affixed to the physical therapy/exercise platform and employing the pilot pulley assembly 4, to maintain a tangential travel profile of the ARC spooler exercise cord assembly A-3, provides the mechanism for performing repetitive exercise regimens at predetermined and preset resistive force levels. Referring now to FIG. 11, the exercise cord A-3.1 and bayonet clips A-3.4 (bayonet clips designator used here to signify any swivel based spring/snap clip device). The cord crimper A-3.2 is designed to crimp the cord end to form a fixed loop to secure one bayonet clip. The other end of the cord is threaded through a cord lock A-3.3, forming a slip knot loop to adjustably secure the other bayonet clip to the cord assembly. The slip knot allows adjustments to the operational length of the cord for individual exercise regimens.

The precision straight scale A-2, as shown in FIG. 10, is employed to determine the patient's strength threshold, this threshold is employed to establish the starting resistance stress levels for the prescribed exercise regime. The precision straight scale is also used to calibrate the resistive force settings on the ARC spooler and to verify progress of the rehabilitation regimen. The precision straight scale is configured with a eyelet A-2.1 (loop or hook) to attach to the exercise cord and has both a hand grip A-4 and a D-ring A-2-2 to permit pulling the scale through its measurable resistance levels.

One of two hand grips A-4 is attached to cord A-3 on the ARC spooler end of the assembly to provide the means to retract the cord for repetitive exercise cycles. The second hand grip is attached at the pilot pulley end of cord A-3 to provide the manual means for the patient to pull the cord A-3 through the prescribed exercise regimen. Alternatively, the multi-purpose harness A-5 may be attached to the roller puller end of cord A-3 to attach to limbs (or other body parts—e.g.; forehead for neck exercises) as dictated by the prescribed exercise regimen.

Referring to FIG. 13, the multi-purpose harness A-5 is constructed from standard off-the shelf components. The harness consists of a polyester web belting A-5.1, D-ring A-5.2, and connector assembly A-5.3. The D-ring is permanently affixed to the body of the web belting for detachably connecting the harness to cord A-3 to the precision scale for use with the patented Portable Exercise Device, the ARC spooler assembly and/or other exercise/physical therapy devices. The male element of the connector is permanently attached to one end of the web belting. The female element of the connector assembly is detachably affixed to the web belting to permit adjustment of the diameter of the looped multi-purpose harness.

Door anchor A-1, as shown in FIG. 14, is constructed from standard off-the-shelf components. The body A-1.1 consists of a polyester web belting. D-ring A-1.2 is permanently affixed to one end of the web belt and the opposite end is sewn into a loop to host locking dowel A-1.3.

The preferred assemblage of this invention, the adjustable resistance rehabilitation exercise device assembly is formed by the adjustable resistance control (ARC) spooler assembly, the channeled 'U' clamp and/or 'O' clamp, and the pilot pulley assembly. Preferably the ARC spooler assembly and the pilot pulley assembly are mated to a clamping device to allow securing the device's components to a chair, desk, bedsteads and/or work or therapy platforms as appropriate. The selection of clamping devices, of necessity, is based on the configuration of the furniture/platform to which the device shall be attached. The 'O' clamp is best suited for application to furniture legs, posts and/or spindle type configurations. The channeled 'U' clamp is more ideally suited for attachment to flat board surfaces such as found in physical therapy plinths, tables, desks and exercise/work bench configurations.

Alternatively, the pilot pulley assembly and/or ARC spooler assembly may be bolted directly to the exercise furniture/platform as a quasi permanent installation negating the need for either the 'O' or channeled 'U' clamp. However, this type installation requires drilling holes in the furniture/platform which may not be acceptable for most home and office furnishings.

Both the 'O' and channel 'U' clamp assemblies are designed and constructed to accommodate both the pilot pulley assembly and the ARC spooler assembly. The critical design constraint for the clamps, the ARC spooler assembly and the pilot pulley is the centerline distance between the two threaded mounting holes per each device.

The ARC, mounted to either the 'O' or channeled 'U' clamp or direct mounted to the exercise furniture/platform, is comprised of a baseplate, assembly mounting ring, spooler sleeve, indexed face plate, extension spring, pressure plate and exterior casing to host and adjust tension (calibrated resistance) on the exercise cord. The exercise cord is inserted through the face plate port and exited through the exterior casing slotted port. Tension/resistance is increased or decreased by rotating the exterior casing which causes the exercise cord to wind around (clockwise rotation of the exterior casing) or unwind from the spooler sleeve (counterclockwise rotation of the exterior casing). Coincidental tension/resistance adjustments may be made by rotation of the indexed face plate in directions opposed to rotation of the exterior casing (clockwise—decreases and counterclockwise—increases resistance).

An ARC spooler sleeve, with 1.25 inches (3.18 cm) usable length, can accept four (4) full winding of the 0.250 inch (0.635 cm) exercise cord. The eight inscribed indexed markers on the face plate then allow for 32 discrete resistance settings. The resistance levels are derived from friction generated by pulling the exercise cord over the spooler sleeve wherein the greater the amount of cord wrapped around the sleeve the greater the resistance. Employing a 1.625 inch (4.1275 cm) diameter spooler sleeve the resistance levels range from ~0.5 lbs (0.2268 kg) to ~50 lbs (22.68 kg). The resistance spectrum, a factor of the usable length and diameter of a spooler sleeve, can be further adjusted to greater levels by increasing either the length or diameter of the spooler sleeve or both.

The ARC spooler assembly, clamps assemblies and pilot pulley assembly may be effectively constructed of polycarbonate plastics, ferrous or no-ferrous metals. However, the exterior casing and cord guide component should be constructed of transparent (clear) polycarbonate plastics to permit viewing the spooler sleeve index line and cord windings for adjusting required resistance levels. Uni-frame molding or machining of the channeled 'U' clamp frame, the ARC spooler base plate and mounting ring, and the pilot pulley assembly is feasible and practical and would eliminate the need for assembling individual parts to form each unit as shown in FIGS. 1 through 9, and as defined in the above detailed descriptions.

The compact construction and aesthetics of the devices are such that when attached to furniture, benches, platforms, and etc., the devices do not attract attention. Further, their compact design and operational configuration ensure that the devices do not protrude beyond the edges of furniture/work platforms, thereby ensuring against individuals knocking/tripping against the device, dislodging it or causing personal injury.

While the 'O' clamp and the channeled 'U' clamp, as defined herein, are designed and configured to be used with the ARC spooler assembly, they both may be effectively employed as stand-alone clamping devices for hobbyists, modelers, workshops and light industry.

The pilot pulley assembly is mounted to the furniture/platform at a distance which provides a tangential profile for the cord passing from the spooler sleeve through the exterior casing's slotted port and to the pilot pulley roller. The tangential profile is essential to negate, or minimize resistance levels which may accrue through friction of the cord rubbing against the exterior casing's slotted port during the exercise routine. Negligible resistance accrued through employment of the pilot pulley roller to establish and maintain the tangential profile and may be ignored as insignificant. When mounted on a common horizontal ARC and pilot roller centerline and the exterior casing slotted port is positioned at either 45° or 315°, the vertical centerline distance is approximately 18.5 inches (47 cm) to establish the tangential profile for the cord. Where horizontal centerline commonality is not a factor, other tangential profiles may be established wherein the exterior casing slotted port may be positioned at any axial setting from 0° through 180°. These profiles are readily established employing legs and adjacent horizontal members of exercise furniture/platforms.

The simplicity of operation, of this device, allows the patient to perform prescribed physical therapy regimens within the established stress levels, independently. This in effect reduces the requirements for therapists hands-on full time supervision, thereby reducing overall costs of rehabilitation therapy sessions. The inherent adaptability of the device to multiple environmental scenarios/facilities negates the requirement for regularly scheduled visits to therapy facilities since the prescribed regimens may be conducted at home, in the office or other occupational environments.

Figure 17:
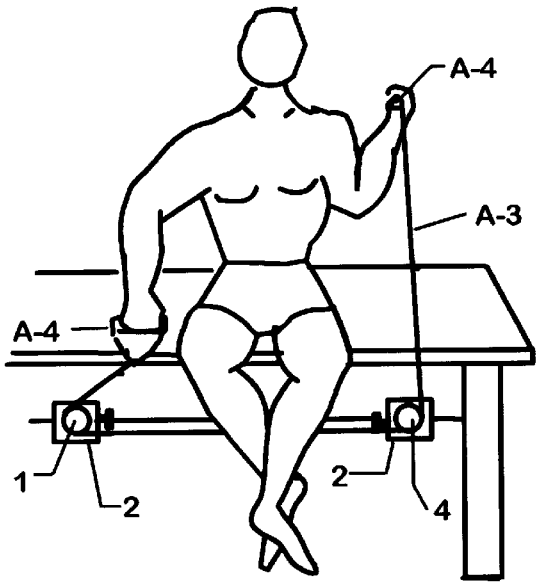
FIG. 17 provides a representation of the adjustable resistance rehabilitation exercise device for military press-up exercises.

Application of this invention to the physical therapy regimes include, but are not limited to the following examples:

a. Isolating intraspinatus and teres minor (refer to FIG. 15):
   - The adjustable resistance control device is detachably affixed to either the channeled 'U' clamp or 'O' clamp (depending on exercise platform configuration).
   - The pilot pulley is detachably affixed to either the channeled 'U' clamp or 'O' clamp (depending on exercise platform configuration).
   - The exercise cord is threaded through the adjustable resistance control device and to the pilot pulley with the fixed bayonet clip end of the cord on the pilot pulley end of the assembly and the detachably affixed bayonet clip on the adjustable resistance control device end of the assembly and the proper level of resistance is preset into the adjustable resistance control device.
   - Hand grips are attached to each bayonet clip.
   - The patient laying on the exercise platform, using the afflicted arm, pulls the exercise cord through the assembly.
   - The patient, having pulled the cord through the assembly, using the other hand grip (to the rear of the adjustable resistance control device) retracts the cord for the next repetition(s).

b. Active/Resistant Hip Flexor (Refer to FIG. 16):
   - The adjustable resistance control device is detachably affixed to either the channeled 'U' clamp or 'O' clamp (depending on exercise platform configuration).
   - The pilot pulley is detachably affixed to either the channeled 'U' clamp or 'O' clamp (depending on exercise platform configuration).
   - The exercise cord is threaded through the adjustable resistance control device and to the pilot pulley with the fixed bayonet clip end of the cord on the pilot pulley end of the assembly and the detachably affixed bayonet clip on the adjustable resistance control device end of the assembly and the proper level of resistance is preset into the adjustable resistance control device.
   - A hand grip is connected to the detachably affixed bayonet clip on the adjustable resistance control device end of the cord. The fixed bayonet clip, on the pilot pulley end of the cord is connected to the multi-purpose harness attached to the patients leg.
   - The patient sitting on the exercise platform (chair) lifts his/her leg pulling the exercise cord through the assembly, then using the hand grip retracts the cord for the next repetition(s).

c. Military Press-up (refer to FIG. 17):
   - The adjustable resistance control device is detachably affixed to either the channeled 'U' clamp or 'O' clamp (depending on exercise platform configuration).
   - The pilot pulley is detachably affixed to either the channeled 'U' clamp or 'O' clamp (depending on exercise platform configuration).
   - The exercise cord is threaded through the adjustable resistance control device and to the pilot pulley with the fixed bayonet clip end of the cord on the pilot pulley end of the assembly and the detachably affixed bayonet clip on the adjustable resistance control device end of the assembly and the proper level of resistance is preset into the adjustable resistance control device.

Hand grips are connected to bayonet clips at both ends of the exercise cord.

The patient sitting on the exercise platform, using the afflicted arm, pulls the exercise cord through the assembly.

The patient, having pulled the cord through the assembly, using the other hand grip (to the rear of the adjustable resistance control device) retracts the cord for the next repetition(s).

We claim:

1. A portable adjustable resistance rehabilitation exercise device, used in conjunction with of exercise platforms, comprising:

a) adjustable resistance control spooler assembly means, comprising:

i) a first cylindrical tube with a machined slot along its horizontal axis, a compression spring and pressure plate enclosed within said first cylindrical tube, ii) a second cylindrical tube enclosed within said compression spring and pressure plate, iii) a mounting ring to receive and maintain positional concentricity for said first and second cylindrical tubes, compression spring and pressure plate;

b) a base plate and a face plate oppositely disposed to each other at extreme positions relative to said spooler assembly means to maintain components of said spooler assembly means at a predefined spooler configuration;

c) a pilot pulley assembly; and d) a flexible cord assembly coiled about said second cylindrical tube and threaded through said pilot pulley assembly.

2. The adjustable resistance rehabilitation exercise device as defined in claim 1, further comprising an 'O' clamp having a pinioned hatch secured by one fixed pin and one removable pin to allow opening the clamp to fit on a leg of an exercise platform and then closing and securing said pinion hatch to apply clamping pressure with a clamp screw.

3. The adjustable resistance rehabilitation exercise device as defined in claim 2, wherein said 'O' clamp further comprises a clamp screw assembly with two clamp screw holes, and threaded holes and a non-threaded hole to accommodate said pilot pulley assembly means and said adjustable resistance control spooler assembly means.

4. The adjustable resistance rehabilitation exercise device as defined in claim 3, wherein said 'O' clamp includes a threaded clamp screw hole to position the clamp screw to accommodate varied profile posts of said exercise platforms.

5. The adjustable resistance rehabilitation exercise device as defined in claims 2, wherein said clamp screw comprises a threaded terminal, a recessed pressure plate and a hex nut to secure said pressure plate detachably to said screw.

6. The adjustable resistance rehabilitation exercise device as defined in claim 1, further comprising a channeled 'U' assembly with detachably affixed base plate secured to frontal and back plates by through bolts for applying clamping pressure with a clamp screw.

7. The adjustable resistance rehabilitation exercise devices as defined in claim 6 wherein said channeled 'U' clamp assembly further comprising a clamp screw assembly with a clamp screw hole, and threaded holes and a non-threaded hole to accommodate said pilot pulley assembly means and said adjustable resistance control spooler assembly means.

8. The adjustable resistance rehabilitation exercise device as defined in claim 6, wherein said channeled 'U' clamp assembly includes a plurality of alternate base plates to accommodate clamping to varied width members of said exercise platforms.

9. The adjustable resistance rehabilitation exercise device as defined in claim 6, wherein said clamp screw comprises a threaded terminal, a recessed pressure plate and a hex nut to secure said pressure plate detachably to said screw.

10. The adjustable resistance rehabilitation exercise device as defined by claim 1, further comprising:

a) first clamp means detachably affixed to exercise platforms, and bolts to detachably secure said adjustable resistance control spooler assembly to said first clamp means; for being and b) second clamp means detachably affixed to said the exercise platforms, and bolts to detachably secure the pilot pulley assembly to said second clamp means for being.

11. The adjustable resistance rehabilitation exercise device as defined by claim 1, further comprising:

a) bolts for directly detachably affixing said pilot pulley assembly to designated exercise platforms; and b) bolts for directly detachably axing said adjustable resistance control spooler assembly to the designated exercise platforms.

12. The adjustable resistance rehabilitation exercise device as defined by claim 1, including calibration means attached to said flexible cord assembly in a predetermined location along its length for providing calibration and verification of preset exercise resistive force levels.

13. The adjustable resistance rehabilitation exercise device as defined by claim 12, wherein said calibration means comprises a precision straight scale.

14. The adjustable resistance rehabilitation exercise device as defined in claim 1, wherein said mounting ring is configured with a machined boss and a dimensioned inside diameter to accept and maintain positional concentricity of said first and second cylindrical tubes, said compression spring and said pressure plate.

15. The adjustable resistance rehabilitation exercise device as defined in claim 1, wherein the mating surfaces of said first cylindrical tube and said face plate are chamfered to permit applying clamping pressure, with a through bolt, to positionally lock said adjustable resistance control spooler assembly means at a predefined setting.

16. The adjustable resistance rehabilitation exercise device as defined by claim 15, wherein said face plate comprises:

a) a dadoed inner surface to accept and lock said second cylindrical tube at a predefined assembly configuration;

b) a centered non-threaded hole through which a carriage bolt screwed into said base plate locks said adjustable resistance control spooler means components at the desired configuration profile;

c) an elongated and chamfered non-threaded hole at the periphery of said face plate through which said flexible cord assembly is threaded into said adjustable resistance control spooler; assembly means and d) index markers to permit accurate settings of predefined exercise resistive forces.

17. The adjustable resistance rehabilitation exercise device as defined in claim 1, further comprising hand grips detachably affixed to said flexible cord assembly to permit applying prescribed levels of tension through said pilot pulley assembly and said adjustable resistance control spooler assembly means.

18. The adjustable resistance rehabilitation exercise device define in claim 1, wherein said flexible cord assembly comprises a cord of predetermined length and spring clips at two ends thereof for detachably connecting said precision straight scale, said hand grips, harnesses and anchors, and means to adjust the length of said flexible cord.

19. The adjustable resistance rehabilitation exercise assembly as defined in claim 18, further comprising multi-purpose harness assembly means comprising:

a) connector assembly means consisting of male and a female connector halves to lock said multi-purpose harness into a loop profile for adaptation to limbs or body parts of patients for exercise regimens;

b) a web belt permanently secured to one end of said connector assembly, the opposite end thereof being threaded through slip knot slots on the mating connector end to permit adjusting said multi-purpose harness assembly means to limbs and body parts of patients requiring therapeutic rehabilitation exercises; and c) a delta ring permanently affixed to said multi-purpose harness assembly means web belt to permit detachably connecting said multi-purpose harness to said spring clip on said flexible cord assembly components of said spooler assembly means.

20. The adjustable resistance rehabilitation exercise assembly as defined in claim 1, further comprising multi-purpose harness assembly means comprising:

a) connector assembly means consisting of male and female connector halves to lock said multi-purpose harness assembly means into a loop profile for adaptation to limbs or body parts of patients for exercise regimens;

b) a web belt permanently secured to one end of said connector assembly means, the opposite end thereof being threaded through slip knot slots on the mating connector end to permit adjusting said multi-purpose harness assembly means to limb and body parts of patients requiring therapeutic rehabilitation exercises; and c) a delta ring permanently affixed to said multi-purpose harness assembly means web belt to permit detachably connecting said multi-purpose harness assembly means to a spring clip on said flexible cord assembly.

* * * * *